US007665640B2

(12) United States Patent
Misumi

(10) Patent No.: US 7,665,640 B2
(45) Date of Patent: Feb. 23, 2010

(54) SYNTHETIC RESIN CLIP AND HANGER COMPRISING SYNTHETIC RESIN CLIP

(76) Inventor: Hideo Misumi, 1-49-2-1203, Hannancho, Abeno-ku, Osaka-shi, Osaka (JP)

( * ) Notice: Subject to any disclaimer, the term of this patent is extended or adjusted under 35 U.S.C. 154(b) by 0 days.

(21) Appl. No.: 12/071,474

(22) Filed: Feb. 21, 2008

(65) Prior Publication Data

US 2008/0201909 A1 Aug. 28, 2008

(30) Foreign Application Priority Data

Feb. 23, 2007 (JP) ..... 2007-043423

(51) Int. Cl.
*A41D 27/22* (2006.01)

(52) U.S. Cl. ..... 223/96; 223/95; 24/331; 24/499

(58) Field of Classification Search ..... 223/90, 223/91, 93, 96, 85, 88, 95; 24/331, 338, 24/106, 499–502
See application file for complete search history.

(56) References Cited

U.S. PATENT DOCUMENTS

| | | | | | |
|---|---|---|---|---|---|
| 2,525,985 | A | * | 10/1950 | Weymouth | 24/511 |
| 2,569,371 | A | * | 9/1951 | Cohen | 24/511 |
| 2,666,240 | A | * | 1/1954 | Maccaferri | 24/501 |
| 2,782,482 | A | * | 2/1957 | Baril et al. | 24/501 |
| 3,950,829 | A | * | 4/1976 | Cohen | 223/91 |
| 4,335,838 | A | * | 6/1982 | Bisk et al. | 223/91 |
| 4,638,930 | A | * | 1/1987 | Blanchard | 223/85 |
| 4,660,750 | A | * | 4/1987 | Blanchard | 223/91 |
| 4,701,983 | A | * | 10/1987 | Warmath | 223/91 |
| 4,878,276 | A | * | 11/1989 | Morrish et al. | 223/91 |
| 4,884,727 | A | * | 12/1989 | Blanchard | 223/93 |
| 5,289,956 | A | * | 3/1994 | Petrou | 223/85 |
| 5,398,854 | A | * | 3/1995 | Blanchard | 223/96 |
| 5,546,640 | A | * | 8/1996 | Kronauer et al. | 24/510 |
| 5,934,525 | A | * | 8/1999 | Blanchard | 223/96 |
| 2004/0099700 | A1 | * | 5/2004 | Misumi | 223/96 |
| 2006/0042050 | A1 | | 3/2006 | Misumi | |

FOREIGN PATENT DOCUMENTS

| | | | |
|---|---|---|---|
| JP | 8-205984 | | 8/1996 |
| JP | 10033351 | A * | 2/1998 |
| JP | 11332723 | A * | 12/1999 |
| JP | 2001046215 | A * | 2/2001 |
| JP | 2006-61365 | | 3/2006 |

* cited by examiner

*Primary Examiner*—Gary L Welch
*Assistant Examiner*—Nathan E Durham
(74) *Attorney, Agent, or Firm*—Wenderoth, Lind & Ponack, L.L.P.

(57) ABSTRACT

A very safe synthetic resin clip is composed of a pair of synthetic resin clip members, and a hanger includes two synthetic resin clips. Each synthetic resin clip member has at least one bracket bearing portion projecting inwardly from an interior portion on a rear face thereof which is provided with a bearing space therein. A pivot shaft is interposed into the bearing spaces of the clip members in use. If a synthetic resin spring has broken and the respective clip members are subjected to a reaction to the spring breakage, the pair of clip members is held by the pivot shaft, secured in position, without flying apart in pieces.

10 Claims, 5 Drawing Sheets

SYNTHETIC RESIN CLIP AND HANGER COMPRISING SYNTHETIC RESIN CLIP

TECHNICAL FIELD

The present invention relates to a synthetic resin clip and a hanger comprising the synthetic resin clip.

BACKGROUND ART

In general, clothes etc. are delivered in a hung-state on a hanger when delivered from a manufacturer of the clothes etc. to a distributor or from the distributor to a retailer. Currently, pursuant to the Product Liability Law, the so-called "PL Law", clothes are delivered after having ascertained with a metal detector that no pins or the like remain in clothes and other sewn products. However, with synthetic resin clips, composed of a "U" shaped metal spring which urges elastically clamping portions at each tip end of clip members in a direction of pressing toward and against each other, the metal detector inadvertently responds to the metal spring in the synthetic resin clips.

In order to deal with such inadvertent action of the metal detector, a type of synthetic resin clip construction is used wherein an elastic synthetic resin spring, which is formed of a composite material having high-density carbonate resin as the main component, and which is bent back to a "U" shape at a middle portion, is mounted into the synthetic resin clip, and such clips are mounted onto the hanger.

However, in case of a synthetic resin clip provided with a synthetic resin spring made of a composite material including a main component of high-density carbonate resin being subjected to repetitive use, the synthetic resin spring occasionally breaks at the bent-back portion and scatters. As a consequence, pieces of the broken synthetic resin spring may injure a user's hand, face and the like, which is a problem in the safety of the clips.

One conceivable way to deal with the above-mentioned problems is to cover the synthetic resin spring at the time of molding the clip members. However, in that case, it causes a bothersome problem, such as the impossibility of the removal of the molded particle from the mold, complication of the mold in structure or an increase in parts of the mold (the number of mold parts) and so on, and in consequence, causing the problem of higher initial costs or running costs.

In view of these problems, the inventor of the present invention has previously proposed a synthetic resin clip comprising of a pair of opposed clip members, each of which has a clamping portion formed at one end, and a synthetic resin spring, which is bent back at the middle and formed in a "U" shape, mounted in straddle position between both of the clip members. The clip members are elastically urged in the direction in which clamping portions of the clip members press against each other due to the synthetic resin spring. Engaging portions are formed on an interior surface portion at the tip ends on both legs of the synthetic resin spring. The clip members are provided with receiving portions, which are engaged with the engaging claw portions, and fly-apart preventing bars are formed so as to extend from an operating portion formed so as to extend from an operating member to a position near the tip of the receiving portion. Spaces for insertion of the engaging portions of the synthetic resin spring are formed between the tip portion sides of the receiving portions and the tip portion sides of the bracket bearing portions. The tips of the receiving portions and the tips of the bracket bearing portions are disposed by overlapping with zero clearance or a slight clearance for enabling the removal of the molded articles from the mold in a direction orthogonal to the moving direction of the mold JP 1996-205984 A.

In such a synthetic resin clip as proposed by the inventor of the present invention, since window holes are opened over the entire width, when the synthetic resin spring breaks, the broken pieces thereof may fly out of the opening into the surroundings. There is thus the possibility that safety cannot be sufficiently ensured.

In view of this, the applicant of the present invention has also previously proposed, in order to provide a synthetic resin clip and a hanger comprising the synthetic resin clip, which is very safe and can be produced at low cost, arranging fly-apart preventing bars across the upper and lower edges of these openings JP 2006-61365 A.

With these conventional synthetic resin clips, while the broken pieces of the synthetic resin spring can be prevented from flying out of the opening into the surroundings when the spring breaks, because the abutting portions of the pair of clips are pushed together in a clamped state on the pivot shaft from the outside by the elastic force of the synthetic resin spring, if the synthetic resin spring breaks the clip members separate from each other, whereby there is the problem that the clip members along with pieces of the broken synthetic resin spring fly out into the surroundings due to the recoil of the synthetic resin spring upon breaking. Thus, there is the problem that safety cannot be said to be sufficiently high.

SUMMARY OF THE INVENTION

The present invention has been proposed in view of the problems as mentioned above. It is thus an object of the present invention to provide a very safe synthetic resin clip, and a hanger composed of the synthetic resin clip, in which even if the synthetic resin spring is broken, the pair of clip members, as well as pieces of a broken synthetic resin spring, are kept from flying apart due to the breakage reaction of the resin spring.

To achieve the above object, a synthetic resin clip according to the present invention is composed of a pair of synthetic resin clip members disposed in an opposite position and mounted on a pivot shaft and a synthetic resin spring formed in a "U" shape by being bent back at a middle portion. The synthetic resin spring is loaded on the synthetic resin clip members to push nipping portions formed at ends of the respective clip members against each other by a force of the synthetic resin spring, whereby an object is grasped between the nipping portions of the clip members.

The synthetic resin clip has at least one bracket bearing portion projecting inwardly from an interior portion on the rear face thereof and is provided with a bearing space thereon. The pivot shaft is interposed into the bearing spaces of the clip members. When in the time of use, when the synthetic resin spring has broken and the respective clip members are subjected to a reaction to the spring breakage, those synthetic resin clip members are held by means of the pivot shaft secured in position without flying apart in pieces.

The synthetic resin clip according to the present invention is also so configured that each one of the synthetic resin clip members is provided with at least one mold part insertion/extraction opening generally on an interior portion thereof, each opening leading to the bearing space of the corresponding bracket bearing portion.

Further, the synthetic resin clip according to the present invention is also characterized in that at least one fly-apart preventing bar is arranged to be extended across window holes in a longitudinal direction of the clip members and a slot is formed on a receiving portion of the respective clip members in an opposite position of the corresponding fly-apart preventing bar thereon.

The hanger according to the present invention comprises a hanger body extending horizontally, a rotary hook provided on the middle of the hanger body and clip mounting portions mounted detachably on either end of the hanger body. At least two synthetic resin clips according to the present invention are mounted on pivot shaft members, the pivot shaft members being provided detachably on the clip mounting portions.

In the synthetic resin clip according to the present invention, when a synthetic resin spring, which presses the nipping portions of a pair of clip members in a direction towards each other, has been broken, the pair of resin clip members are securely kept from flying apart by means of a pivot shaft securely held with bracket bearing portions formed on the respective clip members even if the clip members tend to separate from one another due to a reaction to the breakage of the resin spring, and the synthetic resin clip is very safe.

Further, the synthetic resin clip of the present invention is composed of the pair of clip members provided with a respective bracket bearing portion which holds or passes through a pivot shaft mounted on the synthetic resin clip members as well as a mold portion insertion/extraction opening which leads to a bearing space for passing through the pivot shaft. There is no need of a special mold for molding the bearing space separately so that it is advantageously possible to produce the synthetic resin clip inexpensively.

In addition, a hanger comprising the synthetic resin clip in which the flying apart of the clip members is prevented as described above, has an advantage in that it becomes dramatically safe.

DETAILED DESCRIPTION OF THE INVENTION

Embodiments of the present invention, a synthetic resin clip and a hanger composed of the synthetic resin clips, will be hereinafter described in detail with reference to the accompanying drawings.

Figure 1:
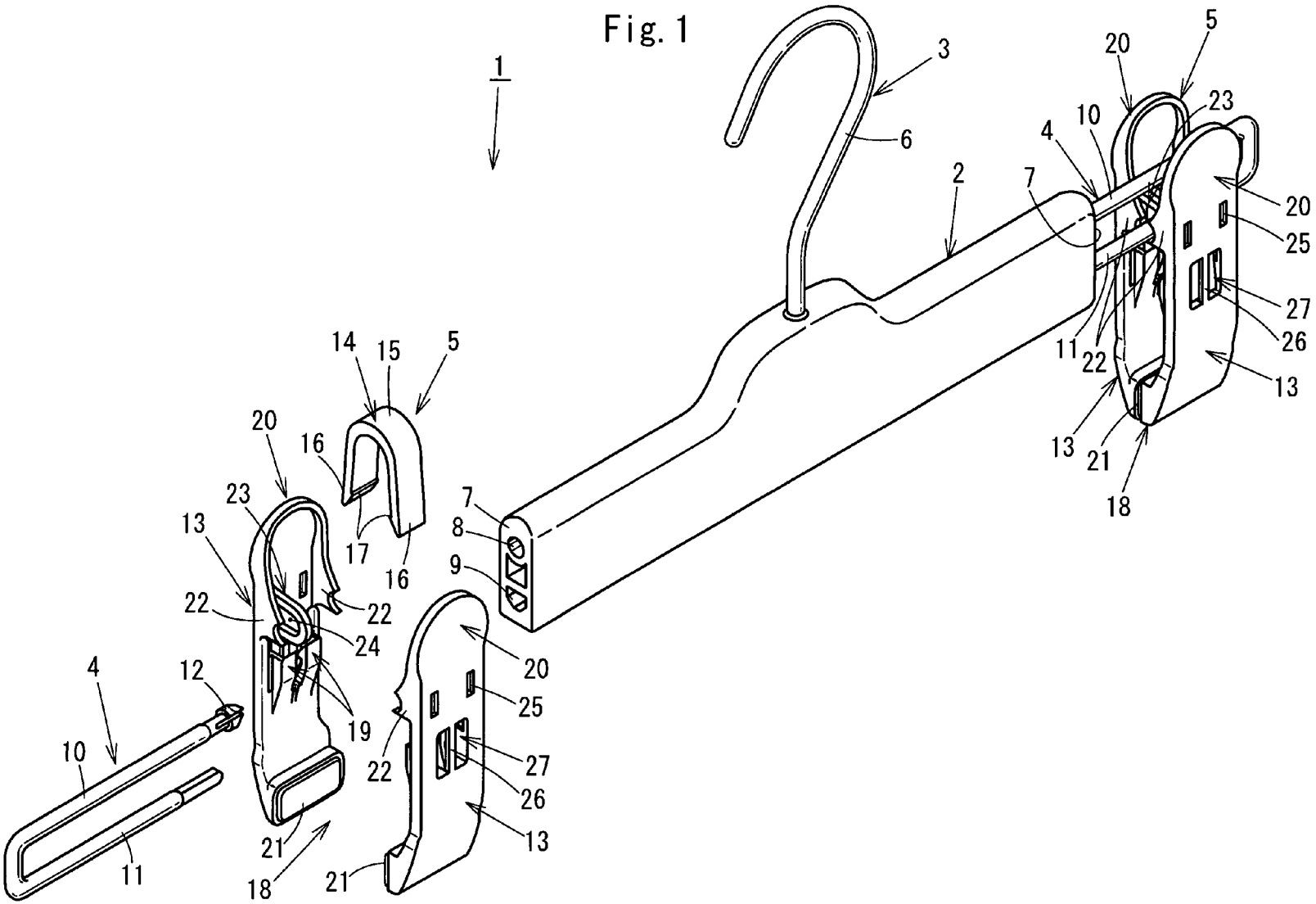
FIG. 1 is a schematic perspective view of the partially exploded synthetic resin clothes hanger of the present invention.
Figure 2:
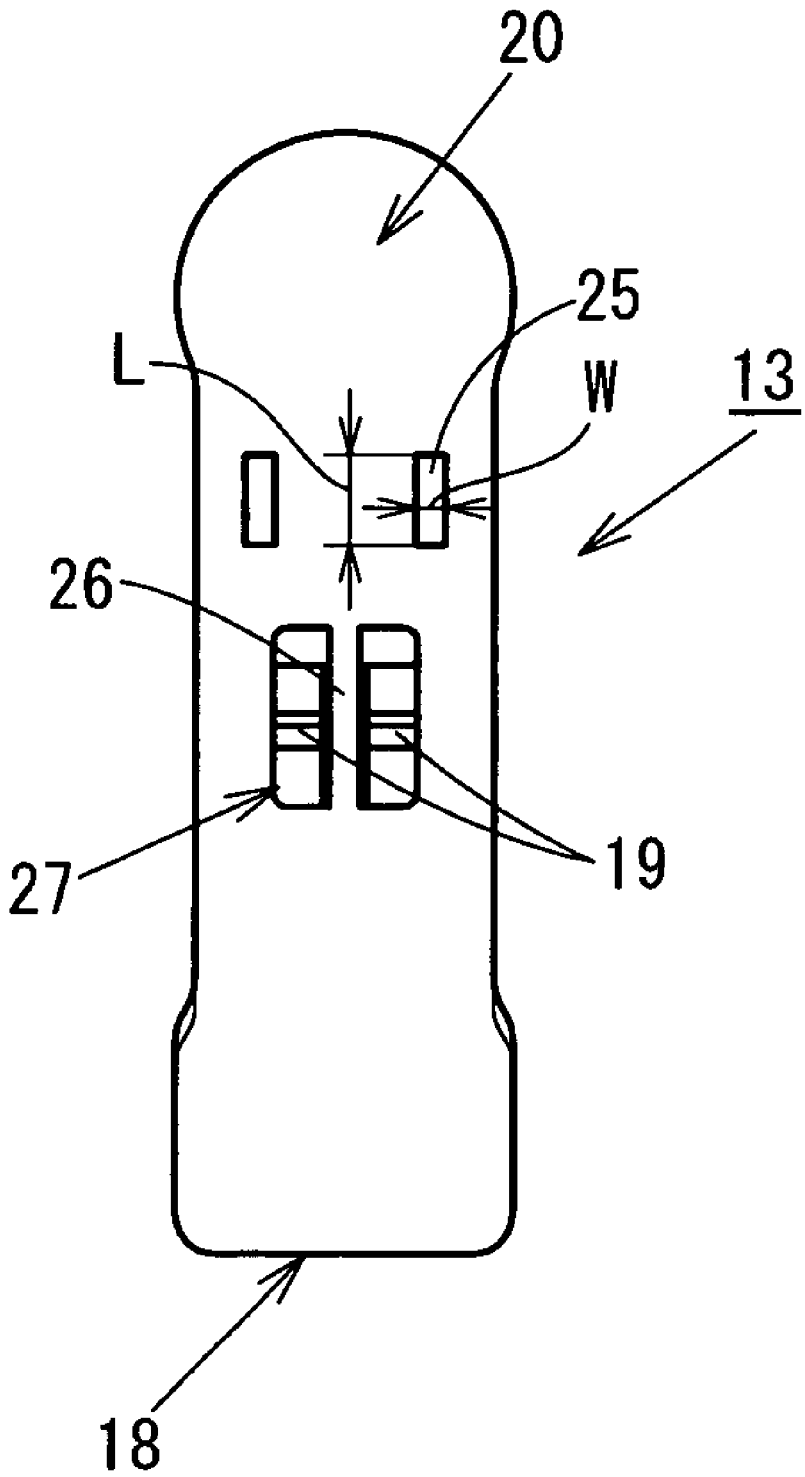
FIG. 2 is a front elevation (surface) of the clip member.

FIG. 1 shows a partially exploded perspective view of a synthetic resin hanger for clothes. In FIG. 1, reference numeral 1 denotes generally the whole configuration of the synthetic resin clothes hanger.

This clothes hanger 1 comprises a generally linear hanger body 2, a hanging portion 3 equipped with a rotary hook 6 at the middle of the hanger body 2, clip support members 4, 4 attached to either end of the hanger body 2, and a pair of synthetic resin clips 5, 5 arranged to be capable of sliding on the clip support members 4, 4.

The above-mentioned hanger body 2 is formed of synthetic resin material. The hanger body 2 has a bulged hanging portion 3 at the middle on which a hook 6 is provided capable of rotation thereat. At either end of the hanger body 2, clip mounting portions 7, 7 are formed for attaching clip support member 4.

The clip mounting portions 7, 7, as shown in FIG. 1, disposed at either end of the hanger body 2 are comprised of two fitting holes 8, 9 which are bored at upper and lower positions.

Further, the clip supporting member 4 is formed of synthetic resin in a sideways-facing "U" shape from an upper crosswise bar portion 10 and a lower crosswise bar portion 11 (pivot shaft) coupled together with a connecting bar portion. The tip end of the upper crosswise bar portion 10 extends further than the tip end of the lower crosswise bar portion 11 horizontally. An extraction stopping member 12 is formed on the tip end of the upper crosswise bar portion 10. The cross-section of the pivot shaft (lower crosswise bar portion) is round.

The above-mentioned hook 6 on the hanging portion 3 and the respective clip supporting members 4 on both ends of the hanger body 2 are formed using a mixture of mica powder and aluminum powder mixed in a resin raw material (molding raw material) for molding. When molded, the surface of these members is put on a metallic color with mica powder or aluminum powder and these members still can be coated with a coating compound which mixes the mica powder and aluminum powder.

In addition, when the hanger body 2 and clip members 13, 13 being put on a metallic color, like the above, a coating compound which mixes the mica powder and aluminum powder can be coated thereon.

Here, a metal detector does not respond to members formed from a mixture of mica powder and aluminum powder mixed in a resin raw material (molding raw material) for molding, or members coated with a coating compound which mixes the mica powder and aluminum powder.

Each synthetic resin clip 5 is mounted to be capable of sliding on the lower crosswise bar portion 11 of the respective clip mounting portions 7, and comprises the pair of synthetic resin clip members 13, 13 disposed in an opposite position and a U shape synthetic resin spring 14 mounted between the resin clip members 13, 13.

The synthetic resin spring 14 is made of composite synthetic resin material comprising high-density carbonate resin as a main component. The resin spring 14 has an inverted "U" shape that is thick at a bent-back portion 15 and becomes gradually thinner at the tips 16. An engaging portion 17 is formed on the inner surface of a claw portion oriented inwardly.

As shown in FIGS. 1 to 4, the clip members 13, 13 are provided with nipping portions 18, 18 at one end portion to which a respective cushioning material, for example, sponge 21 is attached. Further, the clip members 13, 13 are provided with receiving portions 19, 19 formed roughly on the middle of the respective interior portions of the respective clip members for engaging with the claw portions 17, 17 of the resin spring 14. Further, the clip members 13, 13 are provided with operating portions 20, 20 at the other ends of the clip members. When the operating portions 20, 20 are compelled to approach each other against the restoring force of the spring 14 so that the nipping portions 18, 18 are open, and then gripping of the operating portions 20, 20 is released, the nipping portions 18, 18 of the clip members 13, 13 are forced to push against each other by a force of the resin spring loaded between the clip members so that an object, for example, clothes and so on can be nipped between the nipping portions 18, 18.

On both side edge portions of the respective clip members 13, 13, at least one abutting portion 22 having a semi-circular indent at the tip, allows the clip members 13, 13 to rotate while abutting the peripheral surface of the pivot shaft, i.e. the lower crosswise bar portions 11 mounted on the clip mounting portion 7 of the hanger 1 for hanging an object, for example, clothes and so on. The portion 22 is projected from the inner surface (rear face) on which the clip members 13, 13 are disposed opposite each other.

Further, a bracket bearing portion 23 for preventing the clip members 13 from flying apart is formed protruding into one of the gaps S (position biased in a lateral direction from the center of the clip member 13) between the surfaces of the abutting portions 22 at the left and right sides of the synthetic resin spring 14 mounted across each clip member 13, 13.

Figure 3:
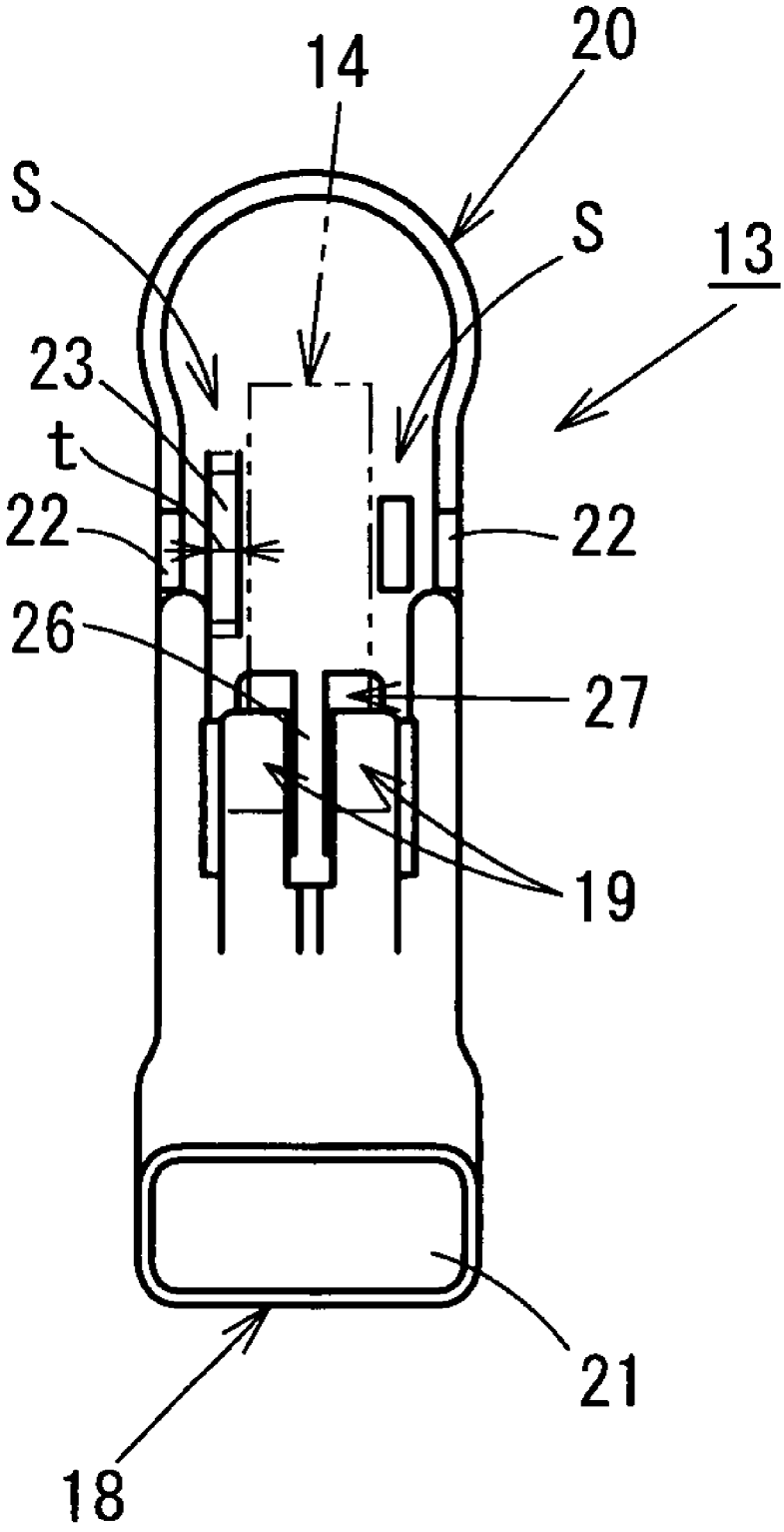
FIG. 3 is a rear elevation (rear face) of the clip member.

Especially as illustrated in FIGS. 1 and 3, this fly-apart preventing portion, that is to say, bracket bearing portions 23, 23 are formed on the rear faces of the respective clip members 13, 13 in a thin-plate shape, and have bearing spaces 24 extended inwardly. Each clip member 13 is provided with at least one mold part insertion/extraction opening 25 generally on the middle thereof, each of which leads to the bearing space 24 of the bracket bearing portion or fly-apart preventing portion 23. The is mold part insertion/extraction opening 25 is formed in a quadrilateral with a width w roughly equal to the thickness t of the bracket bearing portion 23 and a length L roughly equal to the bearing space 24 (see FIG. 2).

Figure 4:
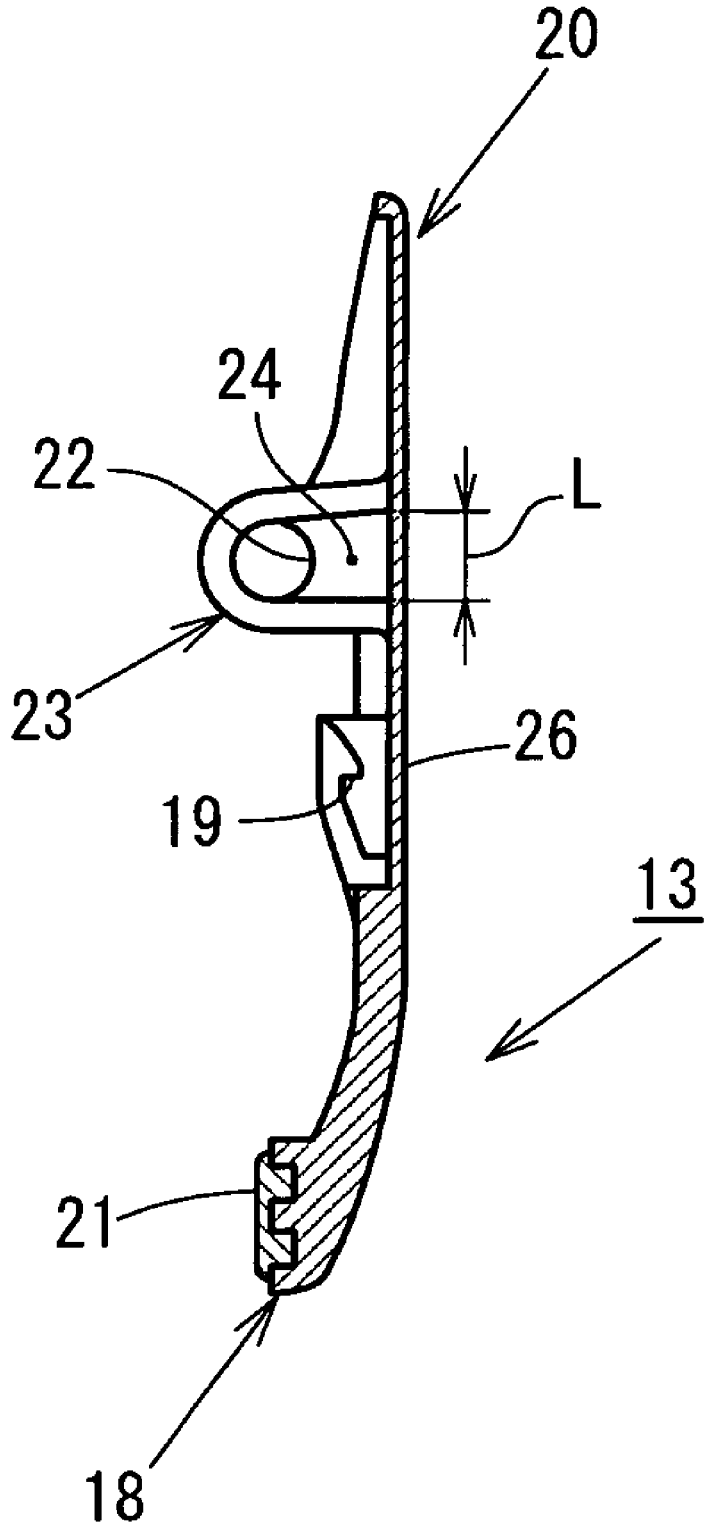
FIG. 4 is a longitudinal sectional side elevation of the clip member.

As illustrated in FIG. 4, when viewed from the side the thus-formed bracket bearing portion 23 cooperates with the abutting portions 22 to clamp the pivot shaft 11 mounted on the clip mounting portions 7.

It is noted that reference numeral 26 in the drawings denotes a fly-apart preventing bar 23 for the synthetic resin spring 14, and is configured in the same manner as that in JP 2006-61365 A.

Specifically, since the clip members 13, 13 are formed by a pair of male and female mold pieces (not shown), in order to form the receiving portions 19 for engaging with the engaging portion, i.e. claw portions 17 formed on the tip ends of the legs of the synthetic resin spring 14, window holes 27 for sliding the mold part through are disposed for removing the molded piece (the molded clip members) from the mold.

Accordingly, at least one fly-apart preventing bar 26 is arranged to be extended across window holes 27, 27 in a longitudinal direction of the clip members 13, 13 and a slot is formed on the area between the receiving portions 17, 17 formed on the respective clip members 13, 13 in an opposite position of the corresponding fly-apart preventing bar 26.

Further, the fly-apart preventing bars 26 are positioned so as to vertically cross with a thin width at a roughly middle position of the window holes. The upper and lower end portions thereof are respectively connected to the upper and lower edges of the window hole 27.

The abutting portions 22, formed on the respective clip members 13 as configured above, are disposed in position and brought to bear on the bearing surface around the pivot shaft portions 11, which are interposed into the bracket bearing portion 23, so that the semicircular indent on its tip abuts the outer peripheral surface of the pivot shaft portion 11 having a circular cross-section. The pair of clip members 13, 13 is pivotally supported on the pivot shaft portion 11.

Next, when the claw portions 17, 17 of the synthetic resin spring 14 are inserted into the receiving portions 19, 19 of the clip members 13, 13 and engaged with the receiving portions, the pair of clip members 13, 13 are compelled to push nipping portions 21, 21 formed at one end of the respective clip members 13, 13 against each other by a force of the synthetic resin spring 14, whereby an object, for example, clothes and so on is grasped between the nipping portions 21, 21 of the clip members 13, 13. In this way, the synthetic resin clip of the present invention is assembled.

The synthetic resin clips 5, 5 as mentioned above are mounted on the pivot shaft portions, i.e. crosswise bar portion 11, 11 securely to the clip mounting portions 7, 7. The respective pivot shaft portions 11 are interposed into the bearing spaces 24, 24 and simultaneously brought to bear on the bearing surface around the pivot shaft portions 11, 11 so that the pivot shaft portions 11 can slide to the left and right.

In this state, the upper crossbar 10 and the pivot shaft portion 11 (lower crosswise bar portion) are inserted into the fitting hole 8 and the receiving hole 9 of the clip support 4, respectively. After the extraction stopping member 12 on the tip of the upper crossbar 10 is latched in the fitting hole 8, two synthetic resin clips 5 are mounted on either end portion of the clip mounting portion 7 on the hanger body 2, whereby a hanger comprising the synthetic resin clip is configured.

Since the thus-configured clothes hanger 1 is entirely formed of synthetic resin, it can be passed through a metal detector (not shown) for detecting pins as is, while clamping clothes etc. (e.g. a skirt) in the synthetic resin clips 5, 5.

In use, when the synthetic resin spring 14 loaded on the clip members 13, 13 occasionally breaks at its bent-back portion or the like, the clip members 13, 13 of the broken clip are subjected to a reaction of the spring breakage, but those clip members 13, 13 are held by means of the pivot shaft secured in position without flying apart in pieces. Also, the pieces of the broken spring are prevented from flying apart by the fly-apart preventing bar 26 through the window holes 27. As a result, injuries to the hands and face by the broken pieces of the synthetic resin spring 14 which flies apart can be eliminated.

As described above, since the synthetic resin clothes hanger 1 according to the present invention has all of its constituent parts formed of synthetic resin, clothes hung on the clothes hanger 1 can be checked as is for the presence of sewing pins, broken sewing machine needles and the like when checked by a metal detector for the presence of sewing pins, broken sewing machine needles and the like.

Accordingly, a detection operation by a metal detector can be conducted quickly and accurately.

Figure 5:
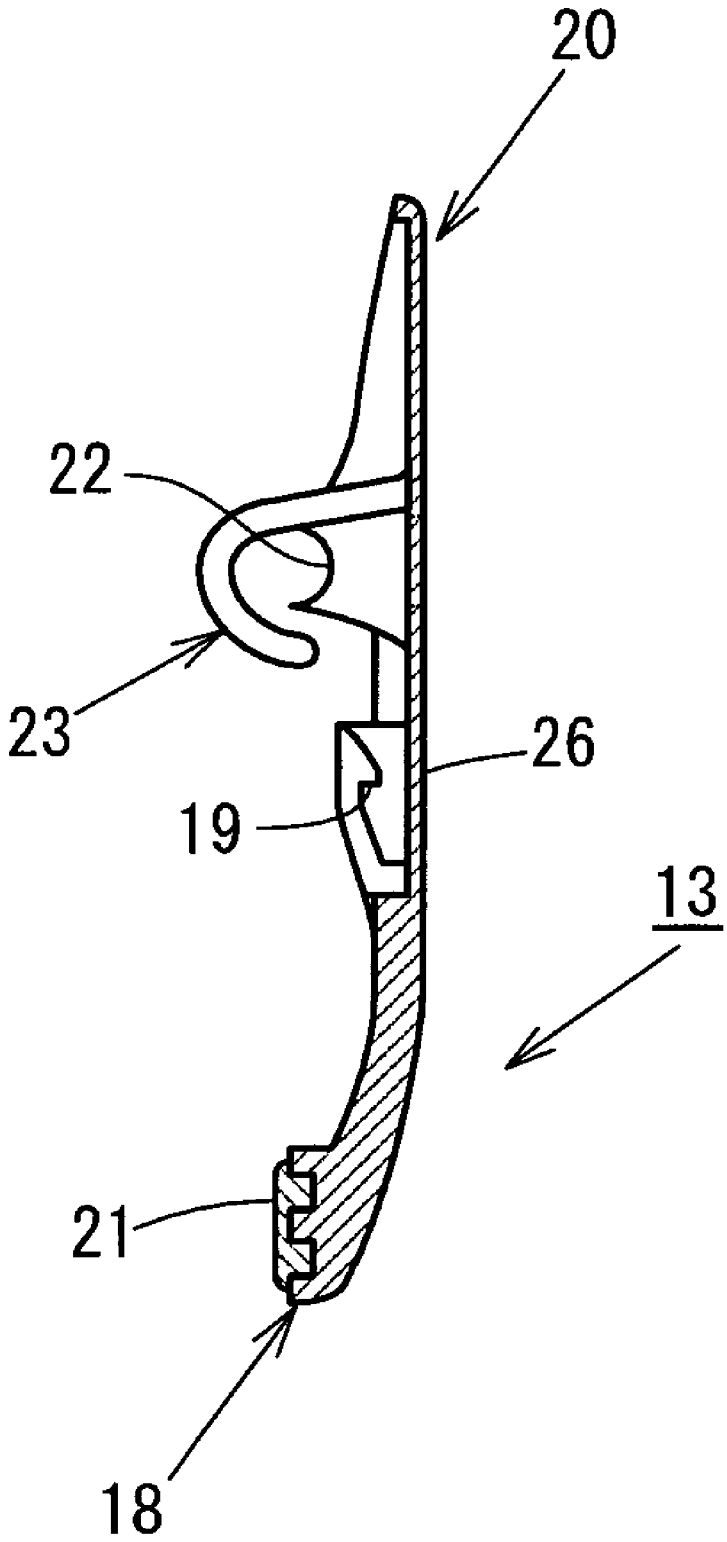
FIG. 5 is a longitudinal sectional elevation of the clip member illustrating an alternative embodiment of the clip members respectively equipped with a bracket bearing for keeping the clip members from flying apart.

It is noted that although in the present embodiment the bracket bearing portion 23 is formed in a thin plate shape from the rear face of the clip member 13 having a space 24 formed inwardly thereof, the bracket bearing portion is not limited to that configuration, and can have a hook shape, for example, as illustrated in FIG. 5.

Further, in the above-described embodiment, while the synthetic resin clip 5 is attached to the synthetic resin clothes hanger 1, the synthetic resin clip 5 is not limited to that configuration. It goes without saying that the synthetic resin clip 5 may be used by itself.

What is claimed is:

1. A hanger comprising:

a horizontally extending synthetic resin hanger body;

a rotatable hanging hook provided in the middle of said hanger body;

a pair of synthetic resin clip mounting portions detachably mounted on respective ends of said hanger body, each of said synthetic resin clip mounting portions including at least one horizontally extending resin pivot shaft mounting at least one synthetic resin clip, wherein each said synthetic resin clip comprises:

a pair of synthetic resin clip members positioned opposite each other and mounted on said pivot shaft, each of said synthetic resin clip members having opposite side edges, an inner face and operating portions at an end of said clip members;

a pair of abutting portions provided on each of said synthetic resin clip members at said opposite side edges thereof and along the length thereof, each of said abutting portions extending inwardly from a respective said inner face of said clip members;

a synthetic resin spring having a U shape that includes a bend at an intermediate portion of said synthetic resin spring, said synthetic resin spring being positioned and arranged between said synthetic resin clip members such that said abutting portions of said synthetic resin clip members abut against an outer periphery of said pivot shaft at two locations at two points along said pivot shaft in a longitudinal direction thereof under force of said synthetic resin spring and such that pushing said operating portions toward each other is against the force of said synthetic resin spring;

nipping portions at another end of said clip members that are moved away from each other when said operating portions are pushed toward each other and that are capable of grasping an object when the pushing of said operating portions toward each other is released;

a pair of bracket bearing portions structured and arranged such that one bracket bearing portion of said pair of bracket bearing portions projects from said inner face between said abutting portions of each of said synthetic resin clip members, wherein said bracket bearing portions project inwardly from opposite directions, wherein said bracket bearing portions have respective bearing spaces formed therein at front-end portions thereof, and wherein said bearing spaces are formed such that said bracket bearing portions bear said pivot shaft with said pivot shaft extending through said bearing spaces and so that said synthetic resin clip members will be held on said pivot shaft by said bracket bearing portions without flying apart upon breakage of said synthetic resin spring.

2. The synthetic resin clip of claim 1, wherein said synthetic resin clip members are each provided with an opening extending from an outer surface thereof to said inner face, said opening opposing a respective one of said bearing spaces of said bracket bearing portions, and said opening being shaped and arranged to receive a molding die that is used to form the respective one of said bearing spaces.

3. The synthetic resin clip of claim 2, wherein:

said synthetic resin spring comprises engaging portions formed on inner portions of tips of said synthetic resin spring;

said pair of synthetic resin clip members have receiving portions formed at inner portions thereof and window holes formed at a mid point on said outer surface thereof at a point opposite to respective said engaging portions of said synthetic resin spring;

each of said window holes is shaped and arranged to receive a molding die for forming a respective opposing receiving portion;

each window hole of said window holes has at least one fly-apart preventing bar that extends across said window hole in a longitudinal direction thereof, and said receiving portions each have a slot formed therein so as to oppose a respective said fly-apart preventing bar, each said slot extending in a longitudinal direction of a respective one of said receiving portions and being shaped and arranged to receive a respective molding die.

4. The synthetic resin clip of claim 1, wherein:

said synthetic resin spring comprises engaging portions formed on inner portions of tips of said synthetic resin spring;

said pair of synthetic resin clip members have receiving portions formed at inner portions thereof and window holes formed at a mid point on an outer surface thereof at a point opposite to respective said engaging portions of said synthetic resin spring;

each of said window holes is shaped and arranged to receive a molding die for forming a respective opposing receiving portion;

each window hole of said window holes has at least one fly-apart preventing bar that extends across said window hole in a longitudinal direction thereof, and said receiving portions each have a slot formed therein so as to oppose a respective said fly-apart preventing bar, each said slot extending in a longitudinal direction of a respective one of said receiving portions and being shaped and arranged to receive a respective molding die.

5. The hanger of claim 1, wherein said bracket bearing portions each comprise a portion extending around said pivot shaft and defining said bearing space.

6. A synthetic resin clip, comprising:

a pivot shaft;

a pair of synthetic resin clip members positioned opposite each other and mounted on said pivot shaft, each of said synthetic resin clip members having opposite side edges, an inner face and operating portions at an end of said clip members;

a pair of abutting portions provided on each of said synthetic resin clip members at said opposite side edges thereof and along the length thereof, each of said abutting portions extending inwardly from a respective said inner face of said clip members;

a synthetic resin spring having a U shape that includes a bend at an intermediate portion of said synthetic resin spring, said synthetic resin spring being positioned and arranged between said synthetic resin clip members such that said abutting portions of said synthetic resin clip members abut against an outer periphery of said pivot shaft at two locations at two points along said pivot shaft in a longitudinal direction thereof under force of said synthetic resin spring and such that pushing said operating portions toward each other is against the force of said synthetic resin spring;

nipping portions at another end of said clip members that are moved away from each other when said operating portions are pushed toward each other and that are capable of grasping an object when the pushing of said operating portions toward each other is released;

a pair of bracket bearing portions structured and arranged such that one bracket bearing portion of said pair of bracket bearing portions projects from said inner face between said abutting portions of each of said synthetic resin clip members, wherein said bracket bearing portions project inwardly from opposite directions, wherein said bracket bearing portions have respective bearing spaces formed therein at front-end portions thereof, and wherein said bearing spaces are formed such that said bracket bearing portions bear said pivot shaft with said pivot shaft extending through said bearing spaces and so that said synthetic resin clip members will be held on said pivot shaft by said bracket bearing portions without flying apart upon breakage of said synthetic resin spring.

7. The synthetic resin clip of claim 6, wherein said synthetic resin clip members are each provided with an opening extending from an outer surface thereof to said inner face, said opening opposing a respective one of said bearing spaces of said bracket bearing portions, and said opening being shaped and arranged to receive a molding die that is used to form the respective one of said bearing spaces.

8. The synthetic resin clip of claim 7, wherein:

said synthetic resin spring comprises engaging portions formed on inner portions of tips of said synthetic resin spring;

said pair of synthetic resin clip members have receiving portions formed at inner portions thereof and window holes formed at a mid point on said outer surface thereof at a point opposite to respective said engaging portions of said synthetic resin spring;

each of said window holes is shaped and arranged to receive a molding die for forming a respective opposing receiving portion;

each window hole of said window holes has at least one fly-apart preventing bar that extends across said window hole in a longitudinal direction thereof, and said receiving portions each have a slot formed therein so as to oppose a respective said fly-apart preventing bar, each said slot extending in a longitudinal direction of a respective one of said receiving portions and being shaped and arranged to receive a respective molding die.

9. The synthetic resin clip of claim 6, wherein:

said synthetic resin spring comprises engaging portions formed on inner portions of tips of said synthetic resin spring;

said pair of synthetic resin clip members have receiving portions formed at inner portions thereof and window holes formed at a mid point on an outer surface thereof at a point opposite to respective said engaging portions of said synthetic resin spring;

each of said window holes is shaped and arranged to receive a molding die for forming a respective opposing receiving portion;

each window hole of said window holes has at least one fly-apart preventing bar that extends across said window hole in a longitudinal direction thereof, and said receiving portions each have a slot formed therein so as to oppose a respective said fly-apart preventing bar, each said slot extending in a longitudinal direction of a respective one of said receiving portions and being shaped and arranged to receive a respective molding die.

10. The synthetic resin clip of claim 6, wherein said bracket bearing portions each comprise a portion extending around said pivot shaft and defining said bearing space.

* * * * *